US005125419A

United States Patent [19]

Heitmann

[11] Patent Number: 5,125,419

[45] Date of Patent: Jun. 30, 1992

[54] METHOD OF AND APPARATUS FOR MAKING PLURAL TOBACCO STREAMS

[75] Inventor: Uwe Heitmann, Hamburg, Fed. Rep. of Germany

[73] Assignee: Körber AG, Hamburg, Fed. Rep. of Germany

[21] Appl. No.: 530,920

[22] Filed: May 30, 1990

[30] Foreign Application Priority Data

Jun. 16, 1989 [DE] Fed. Rep. of Germany ..... 3919720

[51] Int. Cl.[5] ..... A24C 5/18; A26C 5/31

[52] U.S. Cl. ..... 131/84.4; 131/84.1

[58] Field of Search ..... 131/84.1, 84.4, 84.3, 131/108

[56] References Cited

U.S. PATENT DOCUMENTS 4,175,570 11/1979 Heitmann ..... 131/84.3
4,185,644 1/1980 Heitmann et al. ..... 131/109.1
4,564,027 1/1986 Heitmann ..... 131/84.3
4,564,028 1/1986 Heitmann ..... 131/84.4
4,610,260 9/1986 Heitmann ..... 131/84.3
4,889,138 12/1989 Heitmann et al. ..... 131/84.1

*Primary Examiner*—Vincent Millin
*Attorney, Agent, or Firm*—Peter K. Kontler

[57] ABSTRACT

A single stream of comminuted tobacco leaves is divided into two discrete streams each of which contains a surplus of tobacco particles. The surpluses are removed by discrete trimming devices and the thus removed surpluses are conveyed into the distributor which forms the single stream in such a way that the surplus which is removed from one of the discrete streams is reused for the making of a next-following portion of the one discrete stream or for the making of a next-following portion of the other discrete stream. The surplus which is removed from the other discrete stream is reused for the making of a next-following portion of the other discrete stream or for the making of a next following portion of the one discrete stream.

15 Claims, 2 Drawing Sheets

METHOD OF AND APPARATUS FOR MAKING PLURAL TOBACCO STREAMS

BACKGROUND OF THE INVENTION

The invention relates to a method of and to an apparatus for simultaneously forming a plurality of streams of fibrous material, particularly for simultaneously forming several tobacco streams each of which can be converted into a rod-like filler of the type used for the making of cigarette rods, cigar rods or cigarillo rods.

Commonly owned U.S. Pat. No. 4,889,138 to Heitmann et al. discloses a method of and an apparatus for simultaneously making plural tobacco streams. The apparatus which is used for the practice of the patented method employs a distributor (also called hopper) which forms a first tobacco stream and divides the first stream into two discrete second streams each of which contains a surplus of tobacco. The second streams are trimmed to be thus converted into rod-like fillers which are ready for draping into webs of cigarette paper or other wrapping material, and the removed surpluses are returned into the magazine of the distributor to be used for the making of the first stream. The patented apparatus is provided with means for regulating the quantities of tobacco in the second streams and with means for regulating the distribution of tobacco particles across the first stream. This is important because the quality of one second stream must match the quality of the other second stream, i.e., the quality of cigarettes or other rod-shaped smokers' products which contain tobacco of one of the second streams should match the quality of smokers' products which contain tobacco of the other second stream. The makers of rod-shaped smokers' products are particularly concerned with the weight, density and hardness of rod-shaped smokers' products as well as with uniformity of the mixture of two or more tobacco types (such as Virginia, Burley and Oriental) in each second tobacco stream. This cannot be readily achieved by resorting to heretofore known methods and/or to heretofore known apparatus which are used for simultaneous production of plural tobacco streams.

OBJECTS OF THE INVENTION

An object of the invention is to provide a novel and improved method of simultaneously producing a plurality of streams which contain fibrous material, particularly comminuted tobacco leaves, and which exhibit identical characteristics not only as regards their density, hardness and weight per unit length but also as concerns the composition or contents of each unit length of each discrete stream.

Another object of the invention is to provide a novel and improved method of mixing fibrous material during simultaneous production of two or more continuous streams of such material.

A further object of the invention is to further improve the quality of rod-shaped tobacco articles which are turned out by a twin cigarette rod making or like machine.

An additional object of the invention is to automatically alter the mixture in tobacco streams if the actual mixture departs from a desired mixture.

Still another object of the invention is to provide a novel and improved apparatus for the practice of the above outlined method and to construct and assemble the apparatus in such a way that the quality of rod-shaped articles which are produced therein is more uniform than of those which are turned out by conventional apparatus.

A further object of the invention is to provide a novel and improved distributor or hopper which can be used in the above outlined apparatus.

Another object of the invention is to provide the apparatus with novel and improved means for manipulating the surplus which is removed from plural streams containing shreds of tobacco or like fibrous materials.

An additional object of the invention is to provide the apparatus with novel and improved means for mixing fibrous materials in the distributor preparatory to subdivision of a single stream into plural streams.

Another object of the invention is to provide a novel and improved twin cigarette rod making machine.

SUMMARY OF THE INVENTION

One feature of the present invention resides in the provision of a method of simultaneously making a plurality of streams of fibrous material, such as tobacco, particularly of simultaneously making two filler streams which can be converted into fillers of cigarette rods. The method comprises the steps of building a first stream and conveying the first stream along a first path, dividing the first stream into two substantially equal second or additional streams each of which contains a surplus of fibrous material and conveying the second streams along discrete second paths, removing the surplus from each of the second streams, returning the surplus which is removed from one of the second streams into one-half of the first stream, and returning the surplus which is removed from the other second stream into the other half of the first stream.

The dividing step can include converting the aforementioned one-half of the first stream into the one second stream and converting the other half of the first stream into the other second stream. This ensures that the surplus which is removed from one of the second paths is returned into such one second path and that the surplus which is removed from the other second path is returned into the other second path.

Alternatively, the dividing step can include converting the one half of the first stream into the other second stream and converting the other half of the first stream into the one second stream. This ensures that the surplus which is removed from one of the second paths ultimately enters the other second path, and vice versa.

Another feature of the invention resides in the provision of an apparatus for simultaneously making a plurality of streams of fibrous material, such as tobacco. The apparatus comprises conveyor means defining a predetermined path, means for supplying to the conveyor means fibrous material to build a first stream which advances along the path, and means for dividing the first stream into substantially equal first and second additional streams each of which contains a surplus of fibrous material. The predetermined path has first and second portions one of which contains fibrous material for one of the additional streams and the other of which contains fibrous material for the other additional stream. The apparatus further comprises first and second trimming devices having means for removing surpluses from the respective (first and second) additional streams, means for returning the removed surplus from the first trimming device into the first portion of the path and means for returning the removed surplus from the second trimming device into the second portion of the path.

In accordance with a first embodiment of the invention, the means for returning the surplus from the first trimming device has a discharge end or outlet for delivery of fibrous material into that portion of the path which contains fibrous material for the first additional stream, i.e., the surplus which is removed from the first additional stream is recirculated to form part of a next-following portion of the first additional stream, and the surplus which is removed from the second additional stream is recirculated to form part of a next following portion of the second additional stream.

Alternatively, the means for returning the surplus from the first trimming device has a discharge end or outlet for delivery of fibrous material into that portion of the path which contains fibrous material for the second additional stream, i.e., fibrous material which has been removed from the first additional stream is recirculated to form part of the second additional stream and vice versa.

The returning means of the above outlined apparatus can comprise a common conveyor which defines a second path extending from the trimming devices to the predetermined path, and means for subdividing the second path into two sections, one for fibrous material which is removed by the first trimming device and the other for fibrous material which is removed by the second trimming device. The common conveyor can constitute a substantially trough-shaped vibratory conveyor, and the subdividing means can include a suitable partition in the vibratory conveyor. The vibratory conveyor can be provided with two discharge ends or outlets which are staggered with reference to each other in the direction of conveying the removed surpluses along the second path.

The apparatus can comprise a distributor for fibrous material. Such distributor can include the aforementioned supplying means as well as at least a portion of the conveying means for the first stream and the means for dividing the first stream into two additional streams. The discharge ends or outlets of the returning means are or can be disposed in the interior of the distributor.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
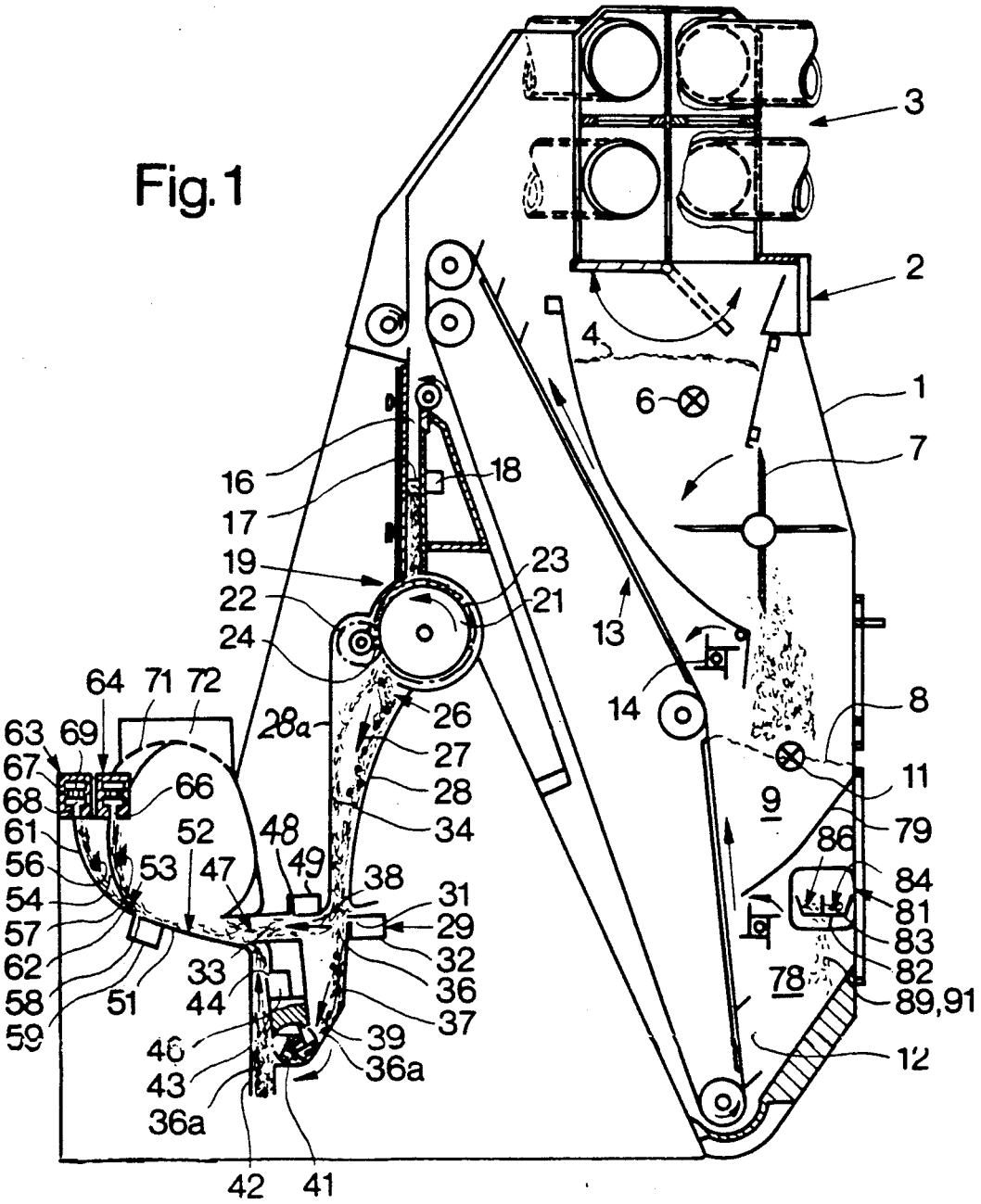
FIG. 1 is a schematic partly elevational and partly vertical sectional view of a portion of a twin cigarette rod making machine with an apparatus which embodies one form of the invention.

FIG. 1 shows a portion of a twin cigarette rod making machine having a distributor or hopper with a first magazine 1 forming part of a so-called predistributor unit 2. The magazine 1 receives batches of comminuted tobacco leaves by way of a system of pneumatic gates 3 when the level of the upper surface of tobacco supply 4 in the magazine 1 descends below that of a photoelectric monitoring device 6. A rotary rake 7 is provided to transfer tobacco particles from the magazine 1 into a main magazine 9 when the level of the top surface of tobacco supply 8 in the magazine 9 descends below that of a photoelectric monitoring device 11. The monitoring device 11 cooperates with the drive for the rake 7 to ensure that the level of the top surface of tobacco supply 8 fluctuates very little when the distributor is in actual use.

The distributor further comprises an endless elevator conveyor 13 with equidistant pockets 12 which serve to draw relatively small batches of tobacco particles from the supply 8 and to dump such batches into an upright duct 16 which accumulates a column 17 of tobacco particles. The batches which are carried by the pockets 12 are equalized by the paddles of a driven wheel 14 so that the duct 16 receives a series of substantially identical batches of tobacco particles. The level of the top surface of the column 17 in the duct 16 is monitored by a set of photoelectronic detectors 18 which control the drive for the elevator conveyor 13 in order to ensure that the height of the column 17 does not appreciably depart from an optimum value.

The outlet 19 of the duct 16 is located above a tobacco withdrawing unit which includes a rotary drum-shaped conveyor 21 having a carding 23 and a rotary picker roller 22 having a set of radially outwardly extending pins or needles 24. The rotational speed of the picker roller 22 greatly exceeds that of the conveyor 21 so that the pins 24 expel tobacco particles which are entrained by the carding 23 and propel such particles in the form of a shower 26 which descends in a downwardly tapering funnel-shaped duct 28 (note the arrow 27). The particles of the shower 26 are accelerated by jets of compressed air issuing from the orifices of nozzles 31 forming part of an accelerating device 29 and receiving compressed air from a plenum chamber 32. The nozzles 31 discharge jets of compressed air transversely of the direction (arrow 27) of downward movement of tobacco particles in the duct 26 so as to form an air curtain which is traversed by heavier tobacco particles 37 (such as fragments of tobacco ribs) but changes the direction of advancement of lighter tobacco particles 33. Such lighter tobacco particles include relatively long tobacco shreds 34 and shorter tobacco shreds 36, and these shreds advance in the direction of arrow 38. The nozzles 31 constitute a classifying unit which segregates the particles of the shower 26 into lighter particles 33 and heavier particles 37. The heavier particles 37 normally entrain some lighter particles **36*a* and the particles 36*a*, 37 jointly descend in the direction of arrow 39**.

The heavier particles 37 are evacuated from the distributor by way of a rotary cell wheel 41 and an outlet 42 but the lighter particles **36*a* enter a duct 43 which draws an ascending air stream due to the injector effect of one or more jets of compressed air which issue from one or more nozzles 44** connected to a plenum chamber 46. The thus recovered shorter particles 36*a* are merged into the mixture of shreds 34 and 36 at a junction 47 downstream of one or more nozzles 48 which are connected to a plenum chamber 49 and serve to discharge jets of compressed air in the direction of arrow 38.

The pins 24 of the picker roller 22 propel longer tobacco shreds 34 against the left-hand wall 28*a* of the duct 28. This contributes to the quality and reliability of the classifying action at 29 because the jets of compressed air issuing from the orifices of the nozzles 31 cannot press the longer shreds 34 against the shorter shreds 36 and/or against the lightweight particles 36*a* which could affect the classifying action because even heavier (but relatively short) particles of tobacco would be likely to be deflected in the direction of arrow 38.

The mixture of particles 34, 36 and 36*a* at the junction 47 forms a relatively wide first stream 52 which is caused to advance along the suitably curved and sloping upper side of a guide 51. The stream 52 is advanced under the action of jets of air issuing from the orifices of the nozzles 31 and 48. The arrangement is such that the first stream 52 is relatively thin and closely follows the outline of the upper side of the guide 51 on its way toward a dividing station 53 where it is converted into two discrete second or additional streams 56 and 57 advancing along two discrete upwardly sloping paths. The means for dividing the first stream 52 into the second or additional streams 56 and 57 comprises a partition 54 downstream of the orifices of nozzles 58 connected to a plenum chamber 59. The jets of compressed air issuing from the orifices of these nozzles compel the streams 56, 57 to advance along their respective paths and to closely follow the concave upper sides of the respective guides 61, 62 which branch off the guide 51 at the dividing station 53.

Figure 2:
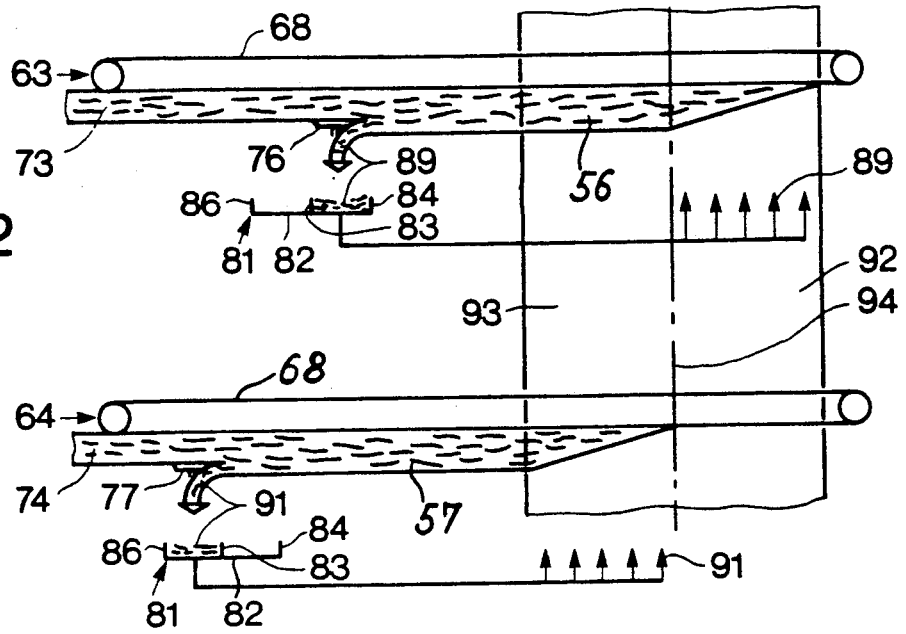
FIG. 2 is a diagrammatic view of that portion of the apparatus wherein the two tobacco streams are trimmed and the thus removed surplus is returned into the distributor for reuse in the making of tobacco streams.

Successive increments of the stream 56 are attracted to the underside of the lower reach of an endless belt conveyor 68 which forms part of a first suction conveyor 63 (see also FIG. 2). The lower reach of the belt conveyor 68 travels along the underside of the perforated bottom wall 67 of a suction chamber 69 which attracts the particles of the stream 56 to the belt conveyor 68. A second suction conveyor 64 which is or can be identical with the conveyor 63 serves to receive and advance the stream 57 along a path which is adjacent and preferably parallel to the path of the stream 56 at the underside of the lower reach of the conveyor 68. This lower reach is located in a stationary tobacco channel 66.

The reference character 71 denotes in FIG. 1 a filter or sieve which permits excess air to escape into an expansion chamber 72.

The stream 56 at the underside of the lower reach of the belt conveyor 68 forming part of the suction conveyor 63 carries a surplus 89 which is removed by a first trimming device 76, and the stream 57 at the underside of the lower reach of belt conveyor 68 forming part of the suction conveyor 64 carries a surplus 91 which is removed by a second trimming deivce 77. This results in conversion of the stream 56 into a rod-like filler 73 which is ready to be draped into a web of cigarette paper or other suitable wrapping material to form a first cigarette rod. The stream 57 is converted into a second rod-like filler 74 which is also ready to be draped so as to form a second cigarette rod. The manner in which a rod-like tobacco filler can be draped into a web of cigarette paper or the like is shown, for example, in commonly owned U.S. Pat. No. 4,185,644 granted Jan. 29, 1980 to Heitmann et al.

In accordance with a feature of the invention, the removed surpluses 89 and 91 are returned into the distributor in such a way that the surplus 89 is used for the making of a next-following portion of the stream 56 and the surplus 91 is used for the making of a next-following portion of the stream 57. To this end, the distributor includes a container or magazine 78 which is installed beneath the main magazine 9 adjacent the ascending run or reach of the endless elevator conveyor 13. The bottom wall 79 of the main magazine 9 (this bottom wall can be made of metallic sheet material) constitutes a partition between the magazine 9 and the container 78. The means for returning the removed surpluses 89 and 91 into the container 78 includes a vibratory conveyor 81 having a trough 82 defining a path for the transport of surpluses 89, 91 from the trimming devices 76, 77 to the container 78 along two discrete sections 84, 86 of an elongated path. This path is divided into the two sections 84 and 86 by a partition 83 in the trough 82 of the vibratory conveyor 81.

Figure 3:
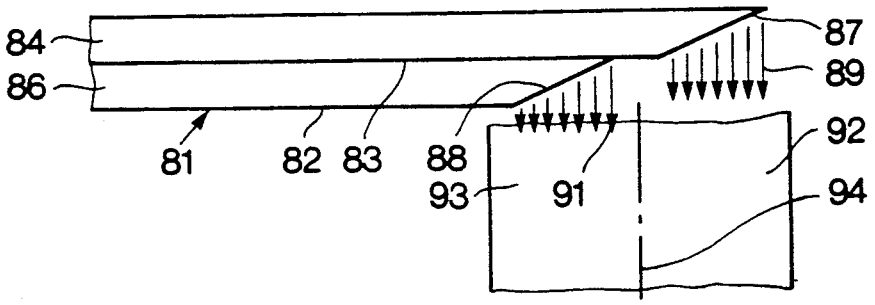
FIG. 3 is a schematic plan view of the means for returning the removed surplus into the distributor.

As can be seen in FIG. 3, the conveyor 81 has two discrete discharge ends or outlets 87, 88 for the surpluses 89 and 91, respectively. The outlets 87, 88 are inclined relative to the direction of transport of surpluses 89, 91 back into the distributor (i.e., into the container 78), and each of these outlets is designed to deliver the removed surplus into one-half of the path for tobacco particles which are gathered into the first stream 52. The imaginary boundary between such halves or portions (92 and 93) of the path for tobacco particles which are gathered into the stream 52 is indicated in FIGS. 2 and 3 by a phantom line 94.

It is to be noted that the container 78 constitutes but one (presently preferred) part of the distributor which receives the surpluses 89, 91 in such a way that the surplus 89 is introduced into the path portion 92 to form part of a next-following portion of the stream 56 (i.e., of that stream from which the surplus 89 is being removed) and that the surplus 91 is introduced into the path portion 93 to form part of a next-following portion of the stream 57 (i.e., of that stream from which the surplus 91 is being removed). This ensures that tobacco which has been destined to form the filler 73 is not mixed with tobacco which has been destined to form the filler 74. It is assumed here that the mixture which forms the supply 8 in the main magazine 9 is homogeneous, i.e., that it contains a uniform blend of two or more different tobaccos or that it contains a single type of tobacco. For example, the outlets 88 and 89 of the vibratory conveyor 81 can be positioned to discharge the respective surpluses 89, 91 into the junction 53 or onto the guide 51 in such a way that the surplus 89 forms part of the stream 56 and the surplus 91 forms part of the stream 57.

FIG. 1 shows the outlets of the vibratory conveyor 81 at right angles to their actual positions which are properly shown in FIGS. 2 and 3. The surpluses 89, 91 which are delivered into the container 78 accumulate next to each other and the pockets 12 of the elevator conveyor 13 draw tobacco particles from each of these accumulations. This ensures that one-half of the column 17 in the duct 16 contains particles of the surplus 89 and the other half of this column contains tobacco particles of the surplus 91. The same holds true for the shower 26 in the duct 28 and for the stream 52 on the guide 51, i.e., one-half of the stream 51 contains particles of the surplus 89 and the other half of the stream 51 contains particles of the surplus 91. The particles of the surplus 89 form part of the stream 56 and filler 73, and the particles of the surplus 91 form part of the stream 57 and filler 74.

Figure 4:
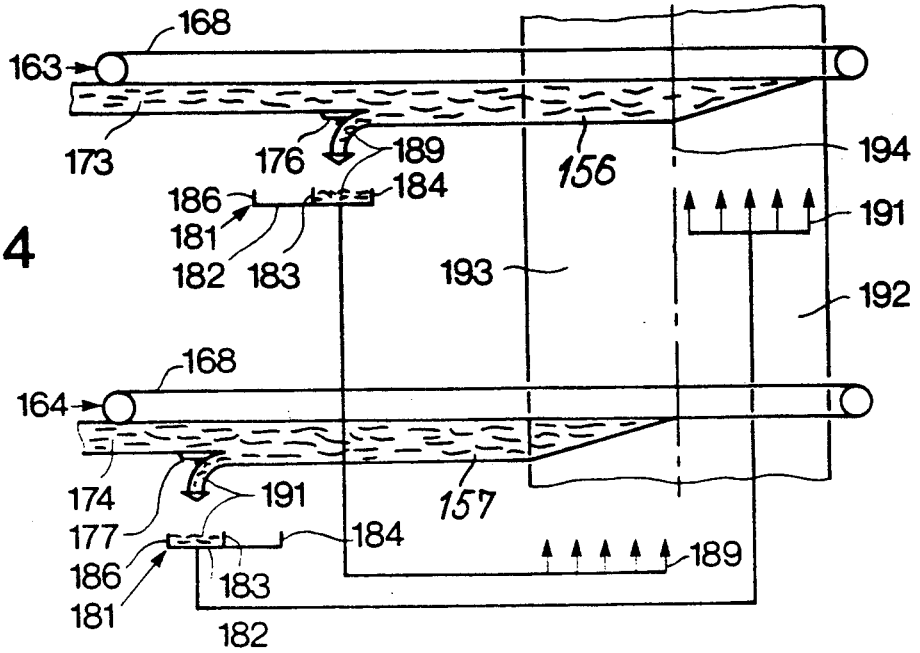
FIG. 4 is a diagrammatic view similar to that of FIG. 2 but showing a portion of a modified apparatus.

FIG. 4 shows a portion of a second apparatus. All such parts of this second apparatus which are identical with or clearly analogous to corresponding parts of the apparatus of FIGS. 1 to 3 are denoted by similar reference characters plus 100. The surplus 189 which is removed from the stream 156 to convert the latter into a filler 173 is returned into the portion 193 of the path for the first stream, and the surplus 191 which is removed from the stream 157 to convert the latter into a filler 174 is returned into the portion 192 of the path for the first stream. Thus, the surplus 189 is reused to form part of a next-following portion of the stream 157, and the surplus 191 is reused to form part of a next-following portion of the stream 156.

An advantage of the apparatus of FIG. 4 is that it can immediately eliminate any differences between the mixtures of tobacco particles which form the streams 156, 157 in a fully automatic way, namely by using the tobacco surplus 191 which has been removed from the stream 157 to form part of the stream 156 and vice versa.

Each of the illustrated apparatus is or can be provided with means for monitoring the quantities of tobacco particles which form the surpluses 89, 91 and 189, 191.

Each of the two illustrated apparatus exhibits the advantage that the streams 56, 57 and 156, 157 are more homogeneous than those which can be produced in heretofore known apparatus. This holds especially true as concerns the uniformity of the mixture of two or more tobaccos which form the discrete second or additional streams. Moreover, such superior homogeneousness can be achieved with tobacco which is already in circulation within the machine, i.e., by appropriately selecting the paths for transport of removed surpluses from the two discrete trimming devices 76, 77 or 176, 177 to selected portions of the path for the first tobacco stream (such as the stream 51 in the apparatus of FIG. 1).

Tobacco stream forming apparatus which are somewhat similar to the apparatus of the present invention are disclosed in commonly owned U.S. Pat. No. 4,610,260 to Heitmann, in commonly owned U.S. Pat. No. 4,564,027 to Heitmann, and in commonly owned U.S. Pat. No. 4,175,570 to Heitmann. Commonly owned U.S. Pat. No. 4,564,028 to Heitmann discloses a trimming or equalizing device which can be utilized in the apparatus of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of simultaneously making a plurality of streams of fibrous material, such as tobacco, comprising the steps of building a first stream and conveying the first stream along a first path; dividing the first stream into two substantially equal second streams each of which contains a surplus of fibrous material and conveying the second streams along discrete second paths; removing the surplus from each of the second streams; returning the surplus which is removed from one of the second streams into one-half of the first stream; and returning the surplus which is removed from the other second stream into the other half of the first stream.

2. The method of claim 1, wherein said dividing step includes converting said one-half of the first stream into said one second stream and converting said other half of the first stream into said other second stream.

3. The method of claim 1, wherein said dividing step includes converting said one-half of the first stream into said other second stream and converting said other half of the first stream into said one second stream.

4. Apparatus for simultaneously making a plurality of streams of fibrous material, such as tobacco, comprising conveyor means defining a predetermined path; means for supplying to said conveyor means fibrous material to build a fist stream which advances along said path; means for dividing the first stream into substantially equal first and second additional streams each of which contains a surplus of fibrous material, said path having first and second portions the first of which contains fibrous material for said first addition stream and the second of which contains fibrous material for said second additional stream; first and second trimming devices having means for removing surplus from the respective additional streams; means for returning the removed surplus from said first trimming device into the first portion of said path; and means for returning the removed surplus from said second trimming device into the second portion of said path.

5. The apparatus of claim 4, wherein said means for returning surplus from said first trimming device has a discharge end for delivery of fibrous material into said first portion of said path.

6. The apparatus of claim 11, wherein said means for returning surplus from said first trimming device has a discharge end for delivery of fibrous material into said second portion of said path.

7. The apparatus of claim 4, wherein said returning means comprise a common conveyor defining a second path extending from aid trimming devices to said predetermined path and means for subdividing said second path into two sections, one for fibrous material which is removed by said first trimming device and the other for fibrous material which is removed by said second trimming device.

8. The apparatus of claim 7, wherein said common conveyor is a vibratory conveyor and said subdividing means includes a partition in said conveyor.

9. The apparatus of claim 7, wherein said conveyor has two outlets which are staggered with reference to each other in the direction of conveying the removed surpluses along said second path.

10. The apparatus of claim 7, further comprising a distributor for fibrous material, said distributor including said supplying means and said returning means having outlets in said distributor.

11. Apparatus for simultaneously making a plurality of streams of fibrous material, such as tobacco, comprising conveyor means defining a predetermined path; means for supplying to said conveyor means fibrous material to build a first stream which advances along aid path; means for dividing the first stream into substantially equal first and second additional streams each of which contains a surplus of fibrous material, said path having first and second portions the first of which contains fibrous material for said first additional stream and the second of which contains fibrous material for said second additional stream; first and second trimming devices having means for removing surplus from the respective additional streams; means for returning the removed surplus from said first trimming device into said second portion of said path; and means for returning the removed surplus from said second trimming device into said first portion of said path.

12. The apparatus of claim 11, wherein said returning means comprise a common conveyor defining a second path extending from said trimming devices to said predetermined path and means for subdividing said second path into two sections, one for fibrous material which is removed by said first trimming device and the other for fibrous material which is removed by said second trimming device.

13. The apparatus of claim 12, wherein said common conveyor is a vibratory conveyor and said subdividing means includes a partition in said conveyor.

14. The apparatus of claim 12, wherein said conveyor has two outlets which are staggered with reference to each other in the direction of conveying the removed surpluses along said second path.

15. The apparatus of claim 12, further comprising a distributor for fibrous material, said distributor including said supplying means and said returning means having outlets in said distributor.

* * * * *